United States Patent [19]

Cyriacy et al.

[11] Patent Number: 4,577,703

[45] Date of Patent: Mar. 25, 1986

[54] APPARATUS FOR MAKING BOREHOLES IN THE LATERAL WALLS OF NARROW UNDERGROUND MINE WORKINGS

[76] Inventors: Frieda Cyriacy, Berliner Ring 61, 7150 Backnang; Horst Albers, Sanatorium Calmette, 7542 Schömberg; Ingeborg Havemann, Schwarenbergs Trasse 50, 7000 Stuttgart, all of Fed. Rep. of Germany

[21] Appl. No.: 563,410

[22] Filed: Dec. 20, 1983

[30] Foreign Application Priority Data

Dec. 24, 1982 [DE] Fed. Rep. of Germany ..... 3247921

[51] Int. Cl.[4] ..... E21B 7/04

[52] U.S. Cl. ..... 175/79; 175/203

[58] Field of Search ..... 175/79, 71, 75–78, 175/220, 122, 162, 203, 61, 62, 320, 323, 113; 166/77; 299/55

[56] References Cited

U.S. PATENT DOCUMENTS 2,516,421 7/1950 Robertson ..... 175/78
2,548,616 4/1951 Priestman et al. ..... 175/203
3,797,589 3/1974 Kellner et al. ..... 175/203 X

FOREIGN PATENT DOCUMENTS 1040943 9/1962 United Kingdom ..... 175/113

*Primary Examiner*—Stephen J. Novosad
*Assistant Examiner*—Thuy M. Bui
*Attorney, Agent, or Firm*—McDougall, Hersh & Scott

[57] ABSTRACT

Difficulties are encountered in mining in making shot-firing boreholes from a narrow cross-heading into the lateral walls at right angles to the length of the cross-heading. The invention provides for this purpose a drilling unit with a flexible drilling shaft (5) formed by a steel spiral, which is brought up in the direction (7) of the cross-heading and is deviated within the unit substantially at right angles into the direction (10) of the borehole. The deviating station (3) provided for this purpose comprises, in a preferred embodiment, a turntable (11) fitted with pairs of rollers (12), which absorbs the substantial feed forces and reduces the wear on the flexible drilling shaft (5). The circulation fluid necessary for the drilling is conveyed through a pressure hose extending within the flexible shaft (5), which is connected pressure-tightly to the ends of the flexible shaft by means of special screw fittings. Special profiles, which are intended to prevent the turns from being rolled up, are provided for the steel spiral of the flexible shaft.

19 Claims, 7 Drawing Figures

Figure 1:
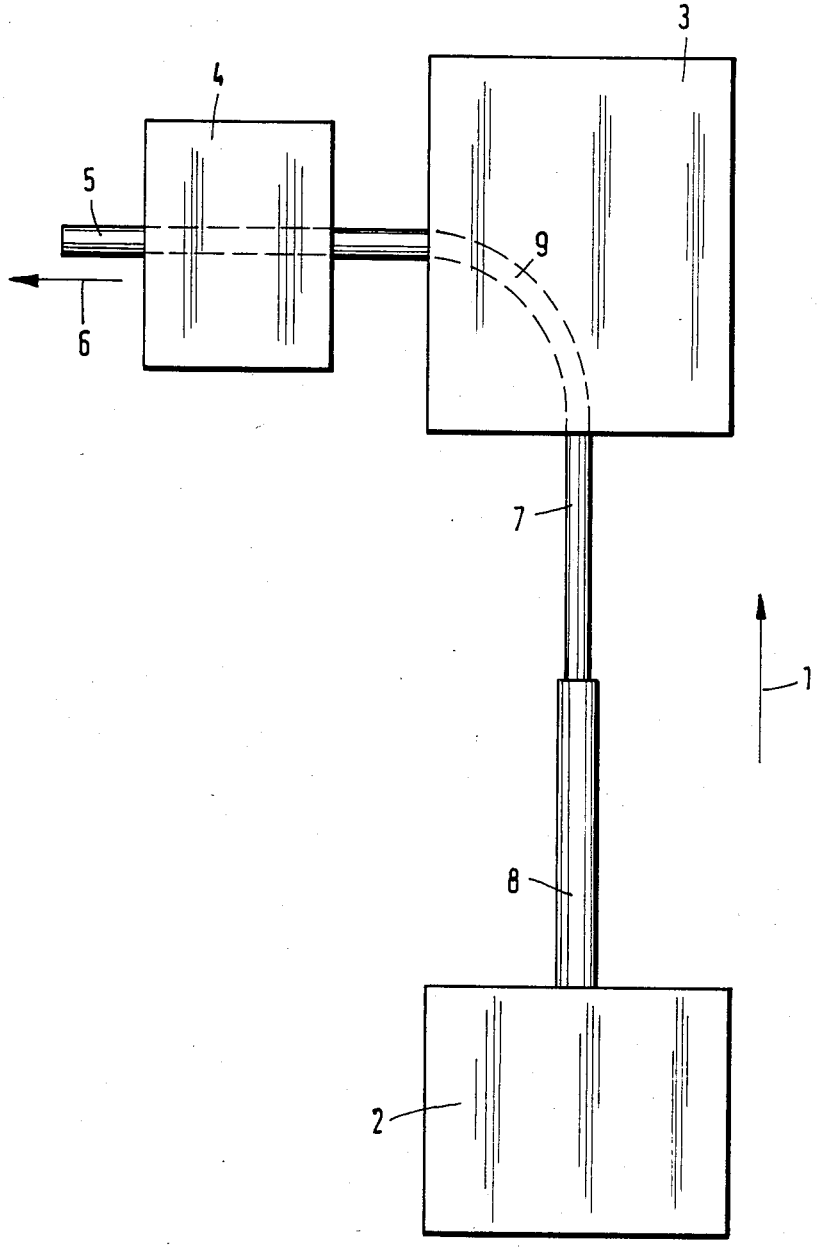

APPARATUS FOR MAKING BOREHOLES IN THE LATERAL WALLS OF NARROW UNDERGROUND MINE WORKINGS

The invention relates to an apparatus for making boreholes particularly in the lateral working face of narrow underground mine workings with a drilling unit optionally transportable on rails within the mine working and braceable to absorb reactive forces in order to drive and feed a drill bit arranged on an extendable drilling shaft, whilst the drilling shaft is provided with a passage channel for circulation fluid under pressure.

Mechanical working appliances such as coal cutters and coal ploughs are being used increasingly to win the coal in bituminous coal mining. These machines are generally moved in a long, narrow and frequently also very low working, which is also called a cross-heading, along the solid coal face on one side of the cross-heading in order to win the coal mechanically. On the side opposite the solid coal, the cross-heading is bounded by the face support which is brought up in each case. Thus long, narrow cross-heading spaces are produced, which in many cases exhibit only a width of approximately 0.5 m and a height of 0.65 m depending upon the seam thickness.

Now it occurs during mining that, for example, the coal plough which is moved along in the cross-heading strikes places of hard rock, which has to be removed by blasting for the purpose of further mining.

For this purpose it is necessary to drill holes up to a depth of approximately 2 m, and having a diameter of approximately 42 mm, into the rock substantially at right angles to the direction of the cross-heading. These boreholes were hitherto generally executed with hand drilling appliances, because the narrow space available, frequently only half a meter wide, does not permit the use of mechanical drilling appliances. For the same reason, it is necessary to extend the drilling rod gradually as the depth of the borehole progresses. This procedure is very time-consuming and constitutes a heavy burden upon the personnel employed. The time factor is so decisive because the coal plough has to be taken out of service during the elimination of the hard rock regions, and there is a corresponding loss of production.

A drilling machine has also already become known which can be moved relatively rapidly to the place of use on the rails laid for the coal plough or other transport means, in order to be used to execute the boreholes there. However, the same space limitation applies to these machines, so that it is continually necessary to interrupt the drilling process in order to extend the drilling rod in short sections at a time.

In order to keep the loss of production of the coal plough within acceptable limits in case hard rock is encountered, the following requirements must be met in making the boreholes: the feed rate of the drill should be approximately 2 m/min., for which a feed loading of up to one ton is necessary at a drill speed of approximately 800 rpm. To clear the boreholes it is necessary to use a circulation fluid which is forced through the passage channel inside the drilling rod at a pressure of at least 25 bar. Whereas, as already mentioned, the borehole should have a diameter of approximately 42 mm for the introduction of the explosive charges, the diameter of the drilling rod must not exceed approximately 30 mm, so that a sufficient return flow space is left for clearing the borehole.

The underlying aim of the invention is to produce an apparatus of the type initially designated, with which it is possible to make boreholes approximately 2 m deep in the solid rock in a direction at right angles to the length of the cross-heading without interruption under the conditions demanded and under the space conditions of a narrow cross-heading.

This aim is achieved in apparatus embodying to the invention in that the drilling unit is provided with a drive unit transportable relative to said unit generally in the direction of the cross-heading. A drilling shaft consisting, at least in part, of a flexible shaft formed by a steel spiral, in the interior of which a passage channel for the circulation fluid is constructed as a pressure hose. The unit is provided with a direction changing unit for the flexible shaft, by means of which the flexible shaft with the drill bit present thereon is turned into a working direction at an angle to the direction of movement of the drive unit.

No particular problems are generally encountered in moving an appropriately heavy unit, which exhibits the required capacity, and which is appropriately braceable against the reactive forces of the drilling, to the required place of use in a short time on the rails or other transport tracks provided for the coal plough. The problem is, with such a unit, to make the boreholes, which are required to be comparatively deep, in the lateral solid rock in a direction substantially at right angles to the length of the narrow cross-heading. Accordingly, the invention provides a flexible drilling shaft consisting of a steel spiral is used, which is turned within the unit out of the drilling direction oriented in general at right angles to the cross-heading into the direction of the cross-heading, so that the entire feed movement for making the borehole can occur in the longitudinal direction of the cross-heading.

Flexible drilling shafts are known per se, however in the present case there is the particular problem that the shaft must absorb high compressive forces, and that the circulation fluid which is at high pressure must be conveyed through its interior.

The drive unit, which is displaceable in the direction of the cross-heading correspondingly to the progress of the borehole depth, is provided essentially for the purpose of generating the rotary movement of the drill. However, the drive unit may at the same time also be constructed additionally to generate the feed movement of the drill with the necessary feed force. However, in such a case the entire feed force must also be turned in the deviating unit for the flexible shaft, which imposes stringent demands upon the construction of the flexible shaft and of the deviating unit. It may therefore be more expedient to provide a separate feed drive means behind the deviating unit at a point where the flexible shaft is already oriented in the direction of the borehole.

Such a feed drive may be effected, for example, by means of clamps closable round the rotating flexible shaft, by means of which the shaft whilst rotating can be loaded with a feed force, and which can be opened after a specific feed movement, retracted and brought into engagement with the flexible shaft for a fresh feed. A clamp unit such as is protected in conjunction with a pipe cleaning appliance by German Pat. No. 2,714,124, may preferably be used for this purpose.

At the start of a drilling, the major part of the flexible shaft is still ahead of the deviating unit, oriented in the direction of movement of the displaceable drive unit. In order for a compressive force to be exerted upon the flexible shaft in this condition, an appropriate guide tube for the shaft, the length of which corresponds at least to the greatest depth of the boreholes to be made, is necessary in front of the deviating unit. The reciprocating movement stroke of the drive unit which is necessary in front of the inlet end of this guide tube must itself in turn correspond to the maximum borehole depth which can be executed by one feed of the drive unit. In the region of this movement path of the drive unit, the drilling shaft may consist of a rigid section coupled to the flexible shaft. However, such a rigid shaft section may also possibly be omitted if the drive unit in turn is provided with a guide tube of corresponding length, which can be telescoped over the guide tube located ahead of the deviating unit. Obviously, these guide tubes may also be changed to adapt to the drilling of boreholes of different depths.

It may likewise be provided that the drilling shaft can be extended to execute a second stroke in order to execute particularly deep boreholes for which a single stroke of the drive unit is not sufficient.

Special demands are imposed for the deviating unit, particularly when the entire feed force has to be exerted by the drive unit, without a further feed unit being provided behind the deviating unit. A simple guide tube is generally inadequate here, because it would wear out in a short time by the rotation of the flexible shaft and simultaneous deviation of the feed force, and would also correspondingly impair the drilling shaft. According to the invention, therefore, a bracing means of the flexible shaft is provided at the deviation point, on which the shaft can roll both in its feed movement and also in its rotation, without any appreciable friction occurring. This is provided by bracing elements in the form of a ball bed, in which respective pairs of balls are mounted for rolling, the balls of a pair being arranged mutually superposed relative to the plane of deviation of the flexible shaft, so that the shaft is braced in the depression between the two highest ball points facing it.

However, the deviating unit preferably comprises a turntable with rollers arranged along its circumference, which are arranged respectively superposed in pairs relative to the plane of deviation of the flexible shaft, and the axes of which form two superposed tangent polygons relative to the turntable. These rollers are advantageously also constructed convexly along their envelope lines, so that the curve of the envelope line approximates the circular shape.

Known flexible shafts coiled from a steel spiral are generally produced from a steel profile of circular cross-section. However, with such shafts, in case high axial forces have to be absorbed there is the danger of the individual turns of the shaft sliding laterally on each other. It is therefore preferable in every case to use a steel profile flattened on opposite sides, so that the individual turns of the shaft are in mutual contact, not only along a circular line as with a round profile, but areally along the flattened regions. The danger of a transverse shift of the turns can be further reduced in the longitudinal direction in one face and a bead in the other face, which interlock when the turns of the shaft are in mutual contact.

A profile which exhibits an offset construction in cross-section, so that the individual turns of the flexible shaft can overlap mutually and exhibit mutual abutment surfaces in both axial and radial directions, is still more advantageous. For a sufficiently intense engagement of the individual turns, the radial bracing surfaces still remain effective even if the flexible shaft becomes spread on its outside within the deviating unit. Such a construction also efficiently prevents the danger of a, for example, weakened turn becoming bent together during the transmission of high torques and making the shaft unserviceable for the further drilling process.

A further difficulty lies in the arrangement of the pressure hose carrying the circulation fluid within the flexible shaft. The flexible shaft is provided at each of its ends with coupling pieces which are screwed into the shaft ends by means of a screw threaded continuation corresponding to the spiral turns of the shaft. It would be possible to connect the one end of the pressure hose to the screw threaded continuation of a shaft coupling piece by screw engagement or otherwise in order to introduce the pressure hose into the flexible shaft and to screw the coupling piece into the shaft end. However, this cannot be done at the second end of the flexible shaft. It is therefore provided according to the invention that the pressure hose is provided at its end with a pipe continuation, as is commercially customary for hydraulic hoses for example. The pipe continuation is introduced into a bore of the shaft coupling piece at one end and is connected and sealed to the shaft coupling piece from the other end. This is expediently effected by a screw pipe fitting with conical ring, for example by a screw fitting of the REMETO type, whilst the shaft coupling piece is constructed as a cap nut. However, the pipe continuation of the pressure hose may also be glued within the shaft coupling piece.

The invention is set forth in the claims appended hereto and forming a part of this specification while an understanding of embodiments thereof may be had by reference to the detailed description taken in conjunction with the drawings.

Figure 3:
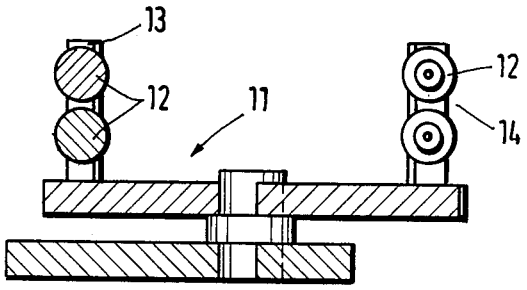
Figure 2:
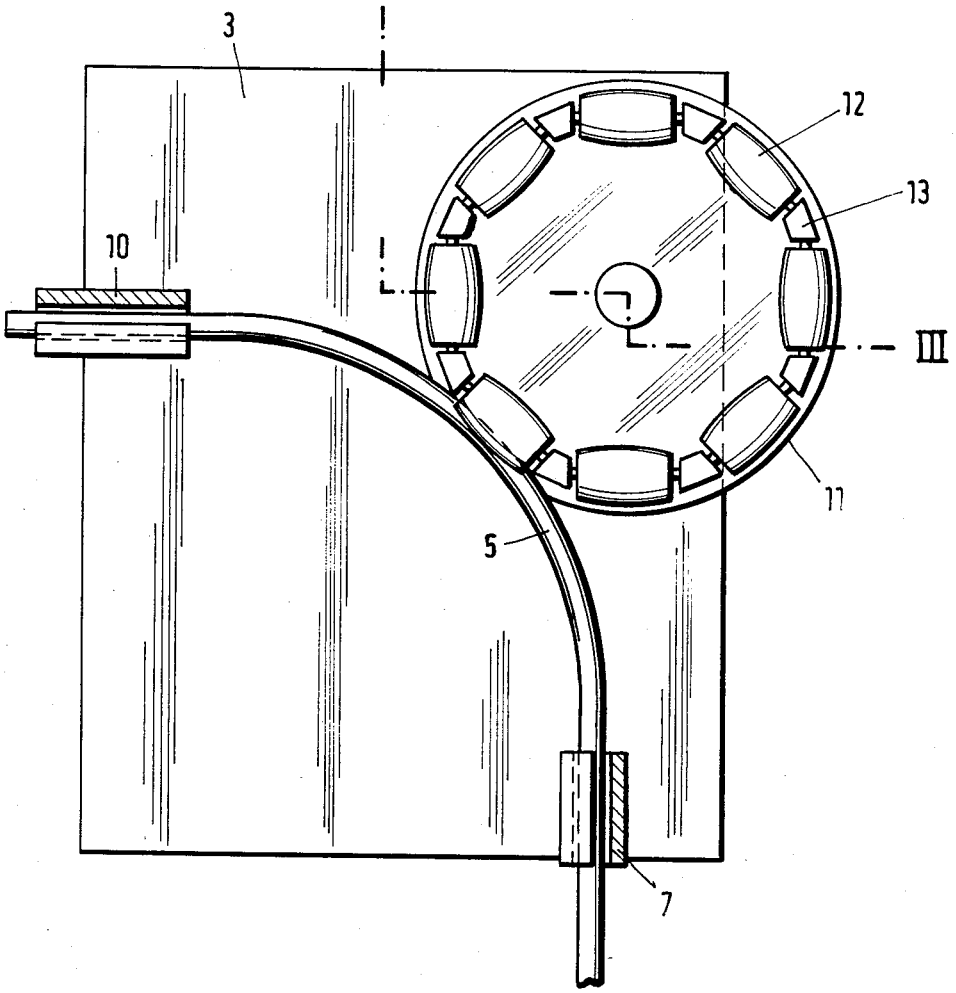
Figure 5:
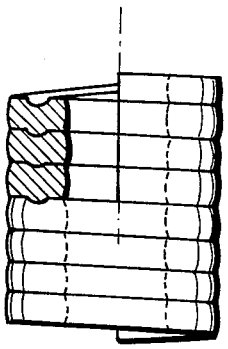
Figure 6:
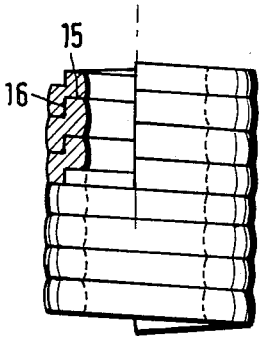
Figure 7:
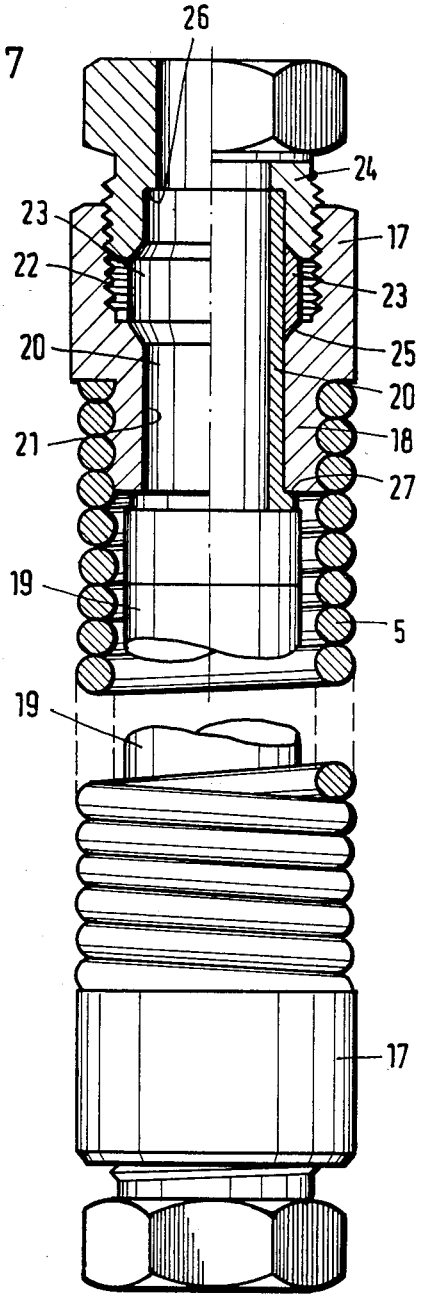

Exemplary embodiments of the invention are explained more fully in detail below with reference to the accompanying drawings, wherein:

FIG. 1 shows a diagrammatic view of the general arrangement of the apparatus, FIG. 2 shows a diagrammatic view of an embodiment of the deviating unit in plan, FIG. 3 shows a section through the turntable of the deviating unit according to FIG. 2, FIGS. 4–6 show embodiments of the flexible shaft and FIG. 7 shows a view of the coupling pieces of a flexible shaft with the fastening of the ends of the pressure hose for the circulation fluid therein.

FIG. 1 illustrates diagrammatically the general arrangement of an apparatus for making boreholes. The direction of the course of the cross-heading is indicated by the arrow 1. The apparatus comprises a drive unit 2, a deviating unit 3 and an auxiliary feed unit 4 for the drilling shaft 5, which is designed essentially as a flexible shaft, and by which a drilling bit (not shown) for making a borehole in a rock wall is driven in the direction of the arrow 6. The entire apparatus is arranged on a common frame (not shown), which is transportable in the direction of the course of the cross-heading 1 on transport tracks provided.

The drive unit 2 contains the rotary drive means for the drilling shaft 6 and is transportable on the common frame (not shown) relative to the deviating unit 3 in the direction of the arrow 1. The drive unit 2 and the deviating unit 3 are each provided with a guide tube 7 and 8 respectively for the flexible shaft 5, which tubes are mutually telescopable during the feed movement of the drive unit 2 relative to the deviating unit 3. The deviation path 9 of the flexible shaft 5 within the deviating unit 3 is merely indicated by dash lines. The auxiliary feed unit 4 is, like the deviating unit 3, mounted stationary on the common frame (not shown) and comprises a feed drive means operating with rotating clamps which is not shown in detail, for the flexible shaft 5.

FIG. 2 illustrates diagrammatically an embodiment of the deviating unit. It shows the course of the flexible shaft 5 which, coming from the drive unit 2, is introduced through the guide tube 7, only the end section of which is shown, into the deviating unit 3. It leaves the deviating unit 3 after a deviation through 90° through a guide piece 10 which guides the flexible shaft 5 towards a borehole to be made.

It is pointed out that the guide piece 10 and the feed unit 4 which may possibly be adjacent to the latter may be constructed variably in their angular position to the guide tube 7, since it may possibly be necessary also to execute boreholes at an angle which differs from the direction at right angles to the direction of movement of the apparatus.

Along its deviation path within the deviating unit 3, the flexible shaft 5 is braced on the outside of its curved configuration by a turntable 11, which is illustrated in vertical section in FIG. 3. The turntable 11 is provided along its circumference with a number of rollers 12 arranged superposed in pairs, which are mounted for rotation in annularly arranged bearing blocks 13. The rollers 12 are of convex construction so that the consecutive combination of their external envelope lines approximates to the circular form. The bearing blocks 13 are offset relative to the external envelope line circle of the rollers 12 and are constructed as small as possible in order to have the circumference of the turntable 11 occupied as extensively as possible by roller surfaces. The pairs of rollers 12 are arranged at such a height that the flexible shaft 5 is braced in the depression 14 (FIG. 3) between the rollers 12 of a pair and is maintained against escape upwards and downwards.

The rollers 12 follow the rotation of the flexible shaft 5, and the turntable 11 rotates onwards in conformity with the feed of the shaft. The turntable 11 is constructed so that it absorbs the total reactive force for the deviation of the feed force applied in the direction of the guide tube 7 into the direction of the guide piece 10. Any friction upon the flexible shaft 5 at its deviation bracing points under the pressure of the axial feed forces applied is also prevented by the nature of the construction of the turntable 11.

In addition to the turntable 11, further deviating devices provided with rolling elements may also be provided within the deviating unit 3 in case of need, if this should be necessary for the reliable guidance of the flexible shaft 5.

Figure 4:
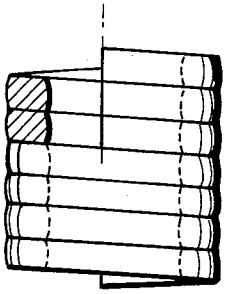

FIGS. 4 to 6 illustrate different embodiments for the flexible shaft 5. A shaft with a steel profile circular in cross-section is restricted in its use to feed forces up to a specific value and likewise to a transmitted torque up to a specific value. It is therefore expedient, and indispensable in some cases, to choose a cross-sectional profile of the steel turns of the flexible shaft which, on the one hand, ensures ultimately areal mutual contact of the individual turns, and on the other hand also prevents any lateral departure or bending together of individual turns under the torque exerted and the feed force applied.

FIG. 4 shows a detail of a flexible shaft, the steel profile of which is simply flattened on opposite sides in order to obtain areal mutual contact of the turns and to prevent the danger of a lateral escape of turns, as is possible in the case of the purely circular linear mutual contact at the contacting surface of circular profiles.

FIG. 5 shows a profiling in which a transverse shift between the individual turns is additionally prevented by interlocking beads and grooves. The shaft illustrated in FIG. 6 shows a particularly advantageous development. Here the steel turns exhibit an offset construction in their cross-sectional profile, so that the individual turns engage mutually. This produces both axial mutual contact surfaces 15 and also radial contact surfaces 16, which further ensure mutual interlocking even in the case of a certain spreading of the flexible shaft on the outside of its deviation path, whereby any transverse shift between the turns or any rolling up of an individual turn is prevented.

FIG. 7 illustrates the coupling ends of a flexible shaft, which is shown with a circular steel profile for reasons of simplicity. The flexible shaft is provided with a coupling piece 17 at each end in order to connect it to the connecting elements. These couplings pieces 17 are each screwed into the end of the flexible shaft 5 by a screw-threaded portion 18, with the screwthread of the screw-threaded portion 18 corresponding to the coil turns of the flexible shaft. The direction of rotation is such that, for a positive direction of rotation of the shaft, the coupling pieces 17 screw themselves further into its ends.

A high-pressure hose 19 is arranged within the flexible shaft 5; it is shown fragmented, like the flexible shaft 5 itself, in FIG. 7 of the drawing. The high-pressure hose 19 is provided at its ends with a pipe extension 20 by which it is introduced into a bore 21 of the coupling piece 17. An enlargement 22 in the coupling piece 17 is provided with a female screwthread, A wedge-shaped ring 23 is pushed onto the pipe 20 of the high-pressure hose 19 from that side of the coupling piece 17 remote from the flexible shaft 5, and is forced against a shoulder 25 in the coupling piece 17 by means of a screw nipple 24. The pipe end of extension 20 of the high-pressure hose 19 is located with its end against a shoulder 26 within the bore of the nipple 24. The pipe extension 20 is also constructed so that it abuts, a further shoulder 27 on the front edge of the coupling piece 17 and is braced there.

By this construction it is possible to connect the ends of the high-pressure hose 19 to the coupling pieces 17 after the latter have been screwed into the ends of the flexible shaft 5.

The nipple 24 is illustrated with a male hexagon for screw engagement in FIG. 7. The diameter of the nipple at this point may also be chosen smaller in order to have available still more space for a further inlet screwthread on the outside of the coupling piece 17, which can then be connected to the adjacent elements, for example to a section of a rigid hollow drilling shaft or to the drilling bit. These adjacent hollow elements themselves serve as a flow channel for the circulation fluid, so that it is generally unnecessary to continue the high-pressure hose provided in the flexible shaft into these elements.

We claim:

1. In apparatus for drilling boreholes into the lateral mining face of subterranean mining areas of narrow width having: a movable drilling means transportable within the mining area; means for propelling and advancing a drill bit attached to a drill shaft provided with a passage for a flushing fluid, and formed in part with a flexible spiral and including a drive unit for rotating the drill shaft and advancing the drill shaft in the direction of movement of the drilling means; and including a deflection unit positioned behind the drive unit on the drilling means for diverting the flexible steel spiral of the drill shaft to move the core bit in the direction of work at an angle to the direction of movement of the drill shaft, the improvement wherein the flexible spiral is formed with flat opposing surfaces contacting each other and wherein the passage for flushing fluid comprises a hose running inside the flexible spiral provided at its ends with pipe extensions and coupling pieces secured to the ends of the flexible spiral sealing the pipe extension and therefore said hose thereto.

2. The improvement of claim 1, wherein one of the flat surfaces of said spiral is provided with a groove running in a longitudinal direction, and the other surface with a corresponding ridge engaging in the groove of the adjacent spiral coil to resist lateral movement of the coils.

3. The improvement of claim 1, wherein the flattened surfaces of said spiral coils are provided with offset portions so that the individual coils of the spiral overlap, whereby lateral movement of the coils is resisted.

4. The improvement of any one of the claims 1 to 3, in which the sealing attachment of the hose is constituted by a collar on a pipe extension secured in a coupling piece by a threaded fastener.

5. The improvement of any one of the claims 1 to 3, in which the deflection unit for the flexible spiral comprises a curved surface engaging said flexible spiral to divert its direction of movement.

6. The improvement of any one of the claims 1 to 3, in which the deflection unit comprises a rotatable plate lying in the path of the flexible spiral, said rotatable plate having rotatable elements positioned along its circumference engaging the flexible shaft in its area of curvature, and rotatable in a plane vertical to the deflection path of the flexible spiral.

7. The apparatus of claim 6 wherein said rotating elements comprise a multiplicity of sets of curved rollers positioned in pairs above one another and the engaged surface of the flexible shaft and wherein said rollers form two tangential surfaces lying above one another and the rotary plate.

8. A device in accordance with one of the claims 1, 2, or 3 in which an adjustable guide pipe encompasses the flexible spiral ahead of the deflection unit.

9. A device in accordance with claim 8, in which the drive unit for the flexible spiral can be advanced relative to the drilling means and includes a pipe telescoping the first mentioned guide pipe through which the rigid drill shaft section extends from the drive unit to the flexible spiral can be advanced to the deflection unit.

10. Drilling apparatus for drilling into the lateral sides of narrow passages comprising means for rotatably driving a drill bit, drive shaft means for connecting the drill bit to said drive means comprising a drill shaft having a flexible portion interposed between said drive means and the drill bit, rotatable means for engaging an external surface of said flexible portion and causing it to move at an angle to the direction in which the drive shaft means extends from said drive means.

11. The drilling apparatus of claim 10 wherein said flexible shaft portion is formed as a spiral and wherein each coil of the spiral has flat opposing surfaces in contact with each other.

12. The drilling apparatus of claims 10 or 11 wherein said rotatable means comprising a rotatable plate having a plurality of pairs of rollers mounted around its periphery and wherein said rollers in each pair are positioned one above the other and said flexible shaft portion is engageable in the space between said pairs of rollers.

13. The drilling apparatus of claims 10 or 11 including means for advancing said drill shaft and said drill bit positioned after said rotatable means.

14. The drilling apparatus of claim 11 wherein one flat surface of said spiral has a groove formed therein and the opposing surface has a ridge formed thereon engaging in the groove in the adjacent spiral turn.

15. The drilling apparatus of claim 11 wherein each flat surface of said spiral has an offset portion and said offset portion of one spiral turn engages the offset portion of the adjacent spiral turn.

16. The drilling apparatus of any of the claims 10, 11, 14 or 15 including a fluid carrying hose extending with said spiral.

17. The drilling apparatus of claim 16 including a coupling piece threaded into each of said flexible spiral.

18. The drilling apparatus of claim 17 including connecting pipe extensions secured at each end of said hose secured in said coupling pieces.

19. The drilling apparatus of claim 18 wherein each coupling piece has a threaded recess formed therein, a collar on the end of each pipe extension engaging in said recess and a hollow nipple engaging each collar to secure said pipe extensions and said hose and provide a passage for fluid flow therethrough.

* * * * *